US007457421B2

(12) United States Patent
Sakagami et al.

(10) Patent No.: US 7,457,421 B2
(45) Date of Patent: Nov. 25, 2008

(54) CIRCUIT AND PROGRAM FOR PROCESSING MULTICHANNEL AUDIO SIGNALS AND APPARATUS FOR REPRODUCING SAME

(75) Inventors: Kei Sakagami, Tokorozawa (JP); Shintaro Hosoi, Tokorozawa (JP); Ikuko Kawamura, Tokorozawa (JP)

(73) Assignee: Pioneer Corporation, Tokyo (JP)

( * ) Notice: Subject to any disclaimer, the term of this patent is extended or adjusted under 35 U.S.C. 154(b) by 815 days.

(21) Appl. No.: 10/786,455

(22) Filed: Feb. 24, 2004

(65) Prior Publication Data

US 2004/0175001 A1 Sep. 9, 2004

(30) Foreign Application Priority Data

Mar. 3, 2003 (JP) ..... P2003-055408

(51) Int. Cl.
*H04R 5/00* (2006.01)

(52) U.S. Cl. ..... 381/27; 381/103; 381/300; 381/306; 381/307; 381/17; 381/18; 381/61; 381/98

(58) Field of Classification Search ..... 381/17–19, 381/27, 98, 310, 300, 306–307, 103, 61–62
See application file for complete search history.

(56) References Cited

U.S. PATENT DOCUMENTS 4,841,573 A * 6/1989 Fujita ..... 381/27
5,727,067 A * 3/1998 Iwamatsu ..... 381/18
5,742,689 A * 4/1998 Tucker et al. ..... 381/17
6,914,988 B2 * 7/2005 Irwan et al. ..... 381/22
7,043,031 B2 * 5/2006 Klayman et al. ..... 381/98
7,292,697 B2 * 11/2007 Tatsuta et al. ..... 381/302
2002/0006206 A1 * 1/2002 Scofield ..... 381/27
2002/0015499 A1 * 2/2002 Willems ..... 381/1
2003/0142830 A1 * 7/2003 Rishoj ..... 381/27

FOREIGN PATENT DOCUMENTS

JP 09-037384 2/1997
JP 10-336797 12/1998
WO 97/25834 7/1997
WO 01/60118 A1 8/2001

* cited by examiner

*Primary Examiner*—Xu Mei
*Assistant Examiner*—Disler Paul
(74) *Attorney, Agent, or Firm*—Ladas & Parry LLP

(57) ABSTRACT

A circuit for processing multichannel audio signals, comprises a frequency characteristics correction device and an output device. The frequency characteristics correction device corrects frequency characteristics of an audio signal of a channel including an audio signal component having a predetermined frequency band, of audio signals of a multichannel comprising at least a right channel and a left channel, in accordance with correction characteristics determined based on a head related transfer function. The output device mixes the audio signal component having the frequency characteristics corrected with an audio signal of the right channel and an audio signal of the left channel to generate mixed output audio signals, and outputting the mixed output audio signals as a right channel output audio signal and a left channel output audio signal.

6 Claims, 8 Drawing Sheets

CIRCUIT AND PROGRAM FOR PROCESSING MULTICHANNEL AUDIO SIGNALS AND APPARATUS FOR REPRODUCING SAME

BACKGROUND OF THE INVENTION

1. Field of the Invention

The present invention relates to a system for processing and reproducing multichannel audio signals.

2. Related Art

With recent years, video software such as movies have included multichannel audio signals recorded therein in accordance with a system such as the Dolby Digital (trademark) or the DTS (Digital Theater System) (trademark), in order to enable an audio reproduction with an enhanced ambience and a powerful sound. In case where the video software is reproduced, image signals are generally reproduced by means of a video monitor, while reproducing multichannel audio signals utilizing amplifiers and loudspeakers for two to eight channels. There are many cases where such multichannel audio signals have a central channel audio signal in which signal components for a human voice such as spoken words contained in video contents such as a video movie, or vocalized lyrics contained in musical contents are included.

In general, when reproducing the above-mentioned multichannel audio signals, a pair of front loudspeakers (for the R-channel and the L-channel) is often disposed on the right and left-hand sides of a video monitor, which is placed in front of an audience, and a central loudspeaker is often disposed above or below the video monitor. In such a case, reproducing the audio signal of the central channel, which is included in the multichannel audio signals, through the central loudspeaker, without subjecting such an audio signal to any processing, causes an audio image for the central channel to be drawn not to a position of the video monitor, but to the central loudspeaker. This may cause an audience to feel that spoken words and/or vocalized lyrics contained in the video contents are heard not from an image such as a person displayed on the video monitor, but from the position located above or below the video monitor, resulting in an uncomfortable feeling.

Japanese Laid-Open Patent Application No. H9-37384 (hereinafter referred to as the "Prior Art 1") discloses one of the methods of solving the above-described problem. According to the method of the Prior Art 1, the audio signals of the central channel, from which signal components having the predetermined frequency band have been removed, are reproduced, thus making it difficult for an audience to recognize the position of a sound source. This utilizes the auditory psychological property that an audience senses as if a sound source exists in his/her viewing direction, when an audio image is too unclear for him/her to recognize the position of the sound source, to cause him/her to feel that spoken words and/or vocalized lyrics based on the audio signals of the central channel come from the center of the video monitor.

The above-described method, which utilizes an auditory illusion of a human being, does not always cause everyone to feel that spoken words and/or vocalized lyrics based on the audio signals of the central channel come from the center of the video monitor. Utilizing the auditory psychological property to make forcedly it difficult for an audience to recognize the position of a sound source may cause him/her to have an uncomfortable feeling accordingly.

SUMMARY OF THE INVENTION

The above-described method, which utilizes an auditory illusion of a human being, does not always cause everyone to feel that spoken words and/or vocalized lyrics based on the audio signals of the central channel come from the center of the video monitor. Utilizing the auditory psychological property to make forcedly it difficult for an audience to recognize the position of a sound source may cause him/her to have an uncomfortable feeling accordingly.

One of the objects of the present invention is therefore to provide a circuit for processing multichannel audio signals, a program for processing such signals and an apparatus for reproducing such signals, which enable the above-described problems to be solved.

In order to attain the aforementioned object, a circuit according to the first aspect of the present invention for processing multichannel audio signals, comprises:

a frequency characteristics correction device for correcting frequency characteristics of an audio signal of a channel comprising an audio signal component having a predetermined frequency band, of audio signals of a multichannel comprising at least a right channel and a left channel, in accordance with correction characteristics determined based on a head related transfer function; and an output device for mixing the audio signal component having the frequency characteristics corrected with an audio signal of the right channel and an audio signal of the left channel to generate mixed output audio signals, and outputting the mixed output audio signals as a right channel output audio signal and a left channel output audio signal.

In the second aspect of the present invention, the circuit may further comprises a signal extracting device for extracting the audio signal component having the predetermined frequency band from the audio signal having the frequency characteristics corrected by the frequency characteristics correction device, the output device mixing the audio signal component as extracted, having the predetermined frequency band with the audio signal of the right channel and the audio signal of the left channel to generate mixed output audio signals, and outputting the mixed output audio signals as a right channel output audio signal and a left channel output audio signal.

In the third aspect of the present invention, the circuit may further comprises a device for extracting an audio signal component having other frequency band than the predetermined frequency band from the audio signal having the frequency characteristics as corrected to generate an extracted audio signal component, and outputting the extracted audio signal component as a central channel output audio signal.

In the fourth aspect of the present invention, the circuit may further comprises a device for mixing the audio signal of the right channel with the audio signal of the left channel to generate a mixed input audio signal, the frequency characteristics correction device correcting frequency characteristics of the mixed input audio signal.

In the fifth aspect of the present invention, the audio signals of the multichannel may comprise an audio signal of a central channel, the frequency characteristics correction device correcting frequency characteristics of the audio signal of the central channel.

In the sixth aspect of the present invention, the correction characteristics may be determined based on a ratio of the head related transfer function for a sound, which is propagated in a straight direction to a front side of an audience, to the head related transfer function for a sound, which is propagated to the audience in a direction deviating rightward or leftward from the straight direction by a predetermined angle.

In the seventh aspect of the present invention, the predetermined frequency band may comprise frequency bands corresponding to a human voice.

In order to attain the aforementioned object, an apparatus according to the eighth aspect of the present invention for reproducing multichannel audio signals, comprises:

a decoder for decoding input audio stream data to generate audio signals of a multichannel; and a circuit for processing multichannel audio signals, the circuit comprising (i) a frequency characteristics correction device for correcting frequency characteristics of an audio signal of a channel comprising an audio signal component having a predetermined frequency band, of audio signals of a multichannel comprising at least a right channel and a left channel, in accordance with correction characteristics determined based on a head related transfer function; and (ii) an output device for mixing the audio signal having the frequency characteristics corrected with an audio signal of the right channel and an audio signal of the left channel to generate mixed output audio signals, and outputting the mixed output audio signals as a right channel output audio signal and a left channel output audio signal.

In order to attain the aforementioned object, a program according to the ninth aspect of the present invention for reproducing multichannel audio signals, is to be executed by a computer, to cause the computer to function as:

a frequency characteristics correction device for correcting frequency characteristics of an audio signal of a channel comprising an audio signal component having a predetermined frequency band, of audio signals of a multichannel comprising at least a right channel and a left channel, in accordance with correction characteristics determined based on a head related transfer function; and an output device for mixing the audio signal having the frequency characteristics corrected with an audio signal of the right channel and an audio signal of the left channel to generate mixed output audio signals, and outputting the mixed output audio signals as a right channel output audio signal and a left channel output audio signal.

DETAILED DESCRIPTION OF THE PREFERRED EMBODIMENTS

Figure 1:
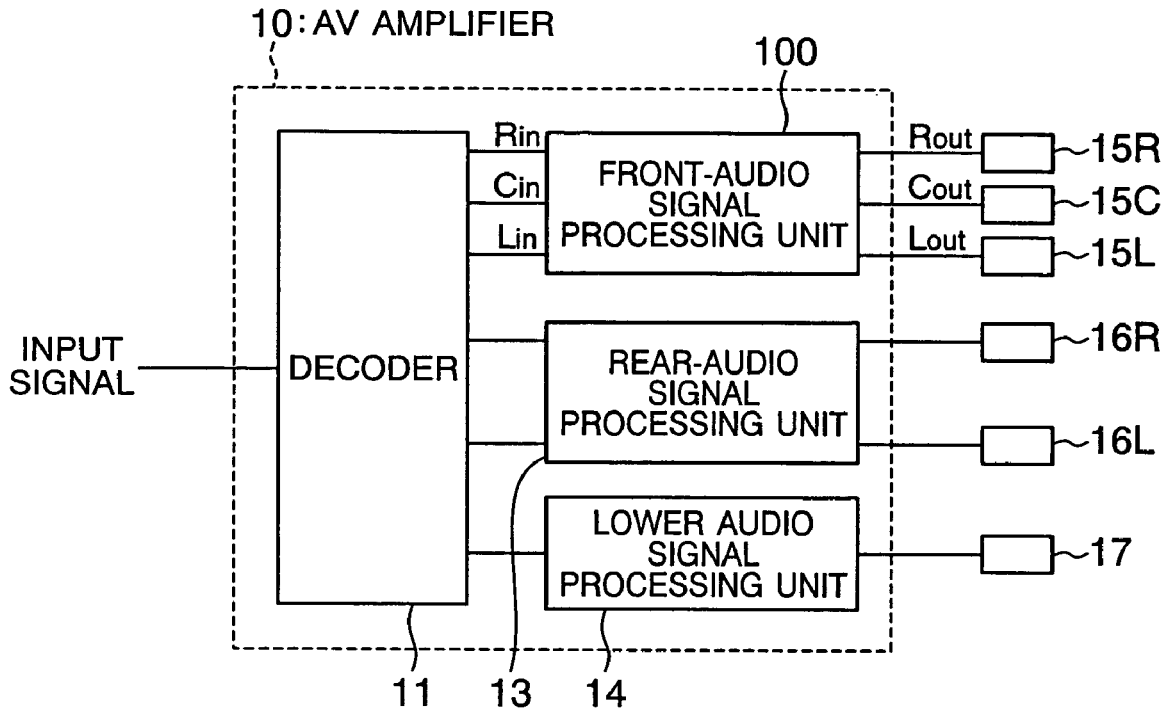
FIG. 1 is a block diagram showing a general structure of an AV amplifier according to an example of the present invention.

Now, embodiments of the present invention will be described in detail below.

In the present invention, of multichannel audio signals, which basically include the left and right channels and the central channel, a central channel audio signal is divided into a midrange in which the human voice components are mainly contained, and the other range, and the audio signal of the midrange is reproduced through front loudspeakers, which are disposed on the right and left-hand side of a video monitor, thus making it possible to solve a problem that spoken words or vocalized lyrics can be heard from a central loudspeaker, which is disposed above or below the video monitor, so as to be inconsistent with an image displayed on the video monitor, thus causing an uncomfortable feeling. A good sound quality cannot be ensured only by taking the above-mentioned measures. More specifically, when the sound obtained by the above-mentioned measures is compared with the sound obtained by reproducing the audio signal of the central channel through the central loudspeaker, the former sound quality is inferior to the latter sound in tone stability, audio image reality and audio image stability, with the result that the sound becomes thinner, the audio image is blurred, leading to no feeling of the audio image reality, and the audio image may easily move when an audience moves his/her head. In addition, the audience can clearly recognize the positions of the right and left-hand side loudspeakers so that the sound can be heard from these loudspeakers.

In view of these problems, the audio signal of the central channel is processed for example by an equalizer in which head related transfer functions are modeled, to correct the frequency characteristics of the audio signal and then the reproduction is carried out utilizing the right and left-hand loudspeakers. This makes it possible to make improvement in tone stability, audio image reality and audio image stability of the signals having the same phase, which are reproduced through the right and left-hand loudspeakers, with the result that the sound in the mid-low range becomes clear, leading to an enhanced clearness of the vocalized lyrics at substantially the same level as the original sound, and the audio image is stationarily held even when an audience moves his/her head. In addition, an audience cannot clearly recognize any positions of the right and left-hand side loudspeakers so that the sound can naturally be heard. It is therefore possible for an audience to clearly heard spoken words or vocalized lyrics, which are contained in the central channel signals, with a proper localization of the audio image in the center of the video monitor, without causing deterioration of the sound quality of the original sound, thus providing useful technical effects.

More specifically, the circuit of the present invention for processing multichannel audio signals, includes: a frequency characteristics correction device for correcting frequency characteristics of an audio signal of a channel including an audio signal component having a predetermined frequency band, of audio signals of a multichannel comprising at least a right channel and a left channel, in accordance with correction characteristics determined based on a head related transfer function; and an output device for mixing the audio signal having the frequency characteristics corrected with an audio signal of the right channel and an audio signal of the left channel to generate mixed output audio signals, and outputting the mixed output audio signals as a right channel output audio signal and a left channel output audio signal.

According to the above-mentioned processing circuit, the frequency characteristics of the audio signal of the channel including the audio signal component having the predetermined frequency band, of the audio signals of the multichannel having the right and left channels, is corrected in accordance with the correction characteristics determined based on the head related transfer function. The audio signal having the frequency characteristics corrected is mixed with the audio signal of the right channel and the audio signal of the left channel to generate mixed output audio signals, and the thus mixed output audio signals are outputted as the right channel output audio signal and the left channel output audio signal.

The above-mentioned predetermined frequency band preferably includes frequency bands corresponding to a human voice. The correction characteristics determined based on the head related transfer function are characteristics with which a correction is made so as to cause an audience to recognize as if the sounds, which are actually propagated from the right and left hand sides of an audience, directly come from the front side of the audience. The correction characteristics are preferably determined based on a ratio of the head related transfer function for a sound, which is propagated in a straight direction to the front side of the audience, to the head related transfer function for a sound, which is propagated to the audience in a direction deviating rightward or leftward from the straight direction by a predetermined angle. This causes the audience to recognize as if the sound obtained by reproduction of the audio signal component, which has the predetermined frequency band and corresponds to a human voice, through the right and left-hand side loudspeakers, comes from the front side of the audience.

In an example case where the inputted multichannel audio signals include the central channel, such a central channel may be set as the above-mentioned channel that includes the audio signal component having the predetermined frequency band. Alternatively, in case where the inputted multichannel audio signals include no central channel, the mixed signals of the audio signals of the right and left channels may be set as the above-mentioned channel that includes the audio signal component having the predetermined frequency band.

In case where the inputted multichannel audio signals include the central channel, it may be adopted processing of extracting an audio signal component having other frequency band than the predetermined frequency band from the audio signal having the frequency characteristics as corrected to generate an extracted audio signal, and outputting the extracted audio signal as a central channel output audio signal.

In addition, there may be provided an apparatus for reproducing multichannel audio signals, which includes: a decoder for decoding input audio stream data to generate audio signals of a multichannel; and a circuit for processing multichannel audio signals, the circuit including (i) a frequency characteristics correction device for correcting frequency characteristics of an audio signal of a channel comprising an audio signal component having a predetermined frequency band, of audio signals of a multichannel comprising at least a right channel and a left channel, in accordance with correction characteristics determined based on a head related transfer function; and (ii) an output device for mixing the audio signal having the frequency characteristics corrected with an audio signal of the right channel and an audio signal of the left channel to generate mixed output audio signals, and outputting the mixed output audio signals as a right channel output audio signal and a left channel output audio signal.

Further, there may be provided a program for reproducing multichannel audio signals, is to be executed by a computer, to cause the computer to function as: a frequency characteristics correction device for correcting frequency characteristics of an audio signal of a channel comprising an audio signal component having a predetermined frequency band, of audio signals of a multichannel comprising at least a right channel and a left channel, in accordance with correction characteristics determined based on a head related transfer function; and an output device for mixing the audio signal having the frequency characteristics corrected with an audio signal of the right channel and an audio signal of the left channel to generate mixed output audio signals, and outputting the mixed output audio signals as a right channel output audio signal and a left channel output audio signal.

EXAMPLES

Now, description will be given below of preferred examples of the present invention with reference to the accompanying drawings.

FIG. 1 shows a general structure of an AV amplifier according to the example of the present invention. The AV amplifier is used as one of the components for reproducing the multichannel audio signals in the apparatus for reproducing video software in which image contents have been recorded for example.

As shown in FIG. 1, the AV amplifier 10 receives stream data of the multichannel audio signals as input signals and outputs them to loudspeakers corresponding to the respective channels. In this example, the multichannel audio signals inputted are audio stream of the so-called "5.1ch". More specifically, the AV amplifier 10 includes a decoder 11, a front audio signal processing unit 100, a rear audio signal processing unit 13 and a lower audio signal processing unit 14. Front loudspeakers, i.e., aright (R) channel loudspeaker 15R, a central (C) channel loudspeaker 15C and a left (L) channel loudspeaker 15L, and rear loudspeakers, i.e., an R-channel loudspeaker 16R and an L-channel loudspeaker 16L, and a lower loudspeaker 17 are connected to the above-mentioned AV amplifier 10. The present invention relates particularly to the processing utilizing the front audio signal processing unit 100.

The decoder 11 decodes the audio stream of 5.1ch, which has been inputted to the AV amplifier 10, to generate audio signals for the front three channels, the rear two channels and the lower one channel. In addition, the decoder 11 supplies the audio signals "Rin", "Cin" and "Lin" for the front three channels to the front audio signal processing unit 100. The decoder 11 also supplies the audio signals for the rear two channels to the rear audio signal processing unit 13, and supplies the audio signal of the lower one channel to the lower audio signal processing unit 14.

Figure 2:
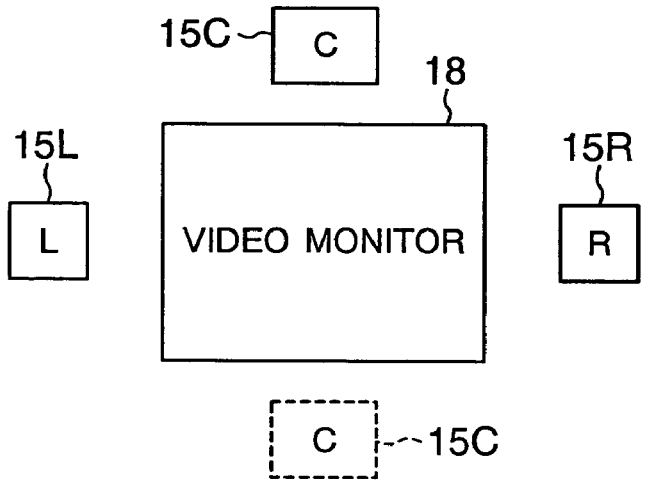
FIG. 2 is a view showing an arrangement example of front loudspeakers, which are connected to the AV amplifier as shown in FIG. 1.

FIG. 2 shows an arrangement example of the front loudspeakers, i.e., the R-channel loudspeaker 15R, the C-channel loudspeaker 15C and the L-channel loudspeaker 15L. In the audio visual system for reproducing the image contents such as movies, the R-channel loudspeaker 15R and the L-channel loudspeaker 15L are generally disposed on the respective right and left hand sides of the video monitor 18 for reproducing the image signals, as shown in FIG. 2. In addition, the C-channel loudspeaker 15C is disposed above the video monitor 18 or below the video monitor 18 as shown in broken lines.

Figure 3:
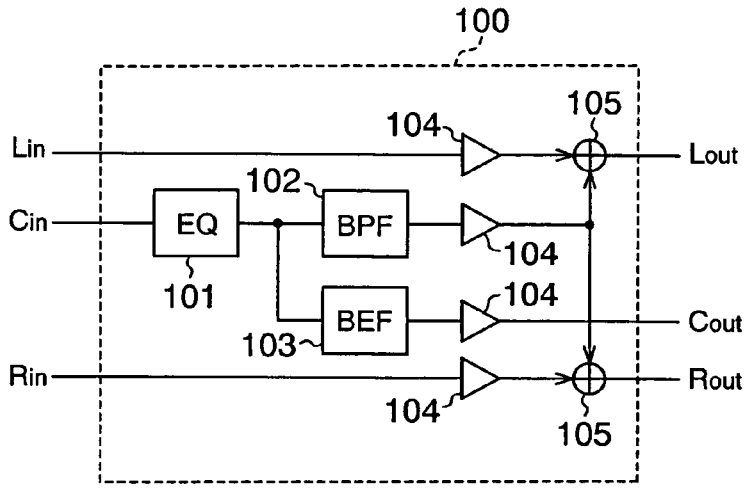
FIG. 3 is a structural example of a front audio signal processing unit as shown in FIG. 1.

FIG. 3 shows a structural example of the front audio signal processing unit. The front audio signal processing unit 100 receives the audio signals "Rin", "Cin" and "Lin" for the front three channels and outputs the output audio signals "Rout", "Cout" and "Lout" for the front three channels to the corresponding loudspeakers 15R, 15C and 15L, respectively. The front audio signal processing unit 100 includes an equalizer 101, a band-pass filter (BPF) 102, a band eliminate filter (BEF) 103, four amplifiers 104 and two adders 105.

Figure 4:
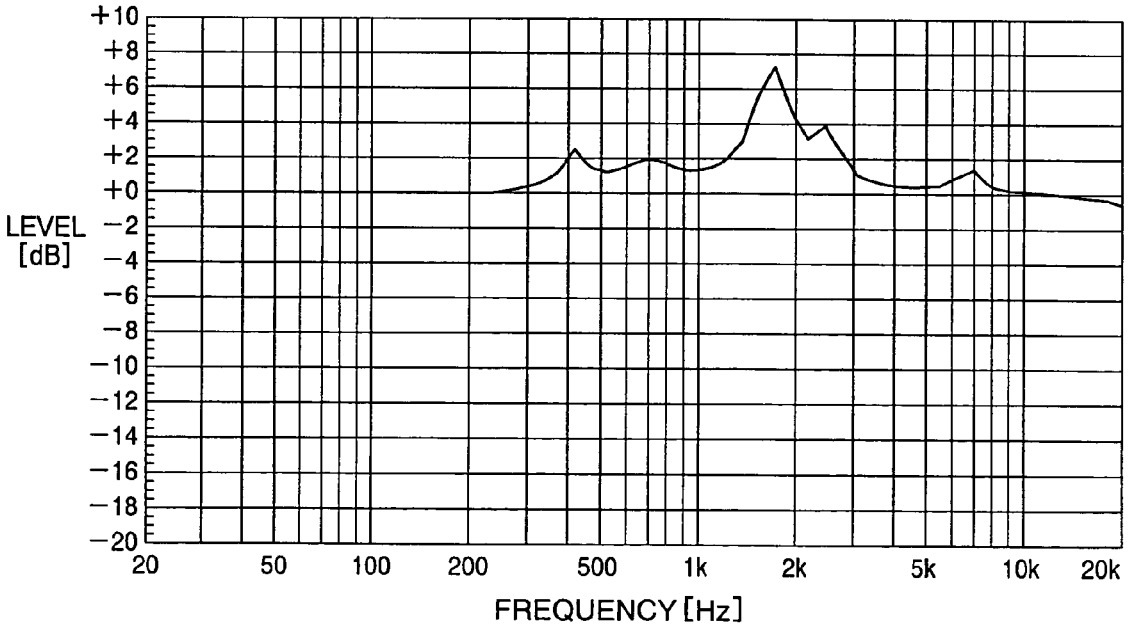
FIG. 4 is a graph showing a characteristics example of an equalizer as shown in FIG. 3.

The equalizer 101 has the characteristics in which the head related transfer functions are modeled. FIG. 4 shows an example of the characteristics. The equalizer 101 boosts a certain band (i.e., the band having a center frequency of 1.7 kHz in the example as shown in FIG. 4) of the input audio signal "Cin" to correct the frequency characteristics and supplies the thus corrected frequency characteristics to the band-pass filter (BPF) 102 and the band eliminate filter (BEF) 103.

Figure 5A:
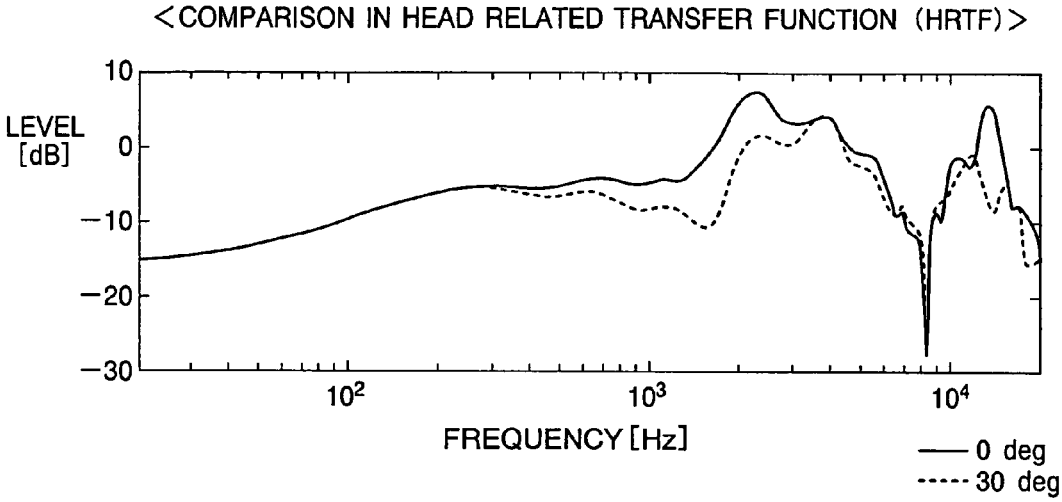
FIG. 5A is a graph showing an example of a head related transfer function and FIG. 5B is a graph showing an example of correction characteristics of the head related transfer function.

There is an assumption that the central loudspeaker 15C is disposed in front of an audience 19 so that the difference in angle between the viewing direction of the audience 19 and the straight line connecting the audience 19 and the central loudspeaker 15C becomes null, and the L-channel loudspeaker 15L and the R-channel loudspeaker 15R are disposed on the lines, which are displaced from the above-mentioned viewing direction of the audience 19 rightward and leftward relative to the audience by an angle of 30 degrees. The frequency characteristics of the sound, which is propagated from the central loudspeaker 15C to the ears of the audience 19 are shown in FIG. 5A in a solid line (with the indication of "0 deg") In addition, the frequency characteristics of the sounds, which are reproduced in the same phase by means of the L-channel loudspeaker 15L and the R-channel loudspeaker 15R and then propagated to the ears of the audience 19 are also shown in FIG. 5A in a broken line (with the indication of "30 deg").

Figure 5B:
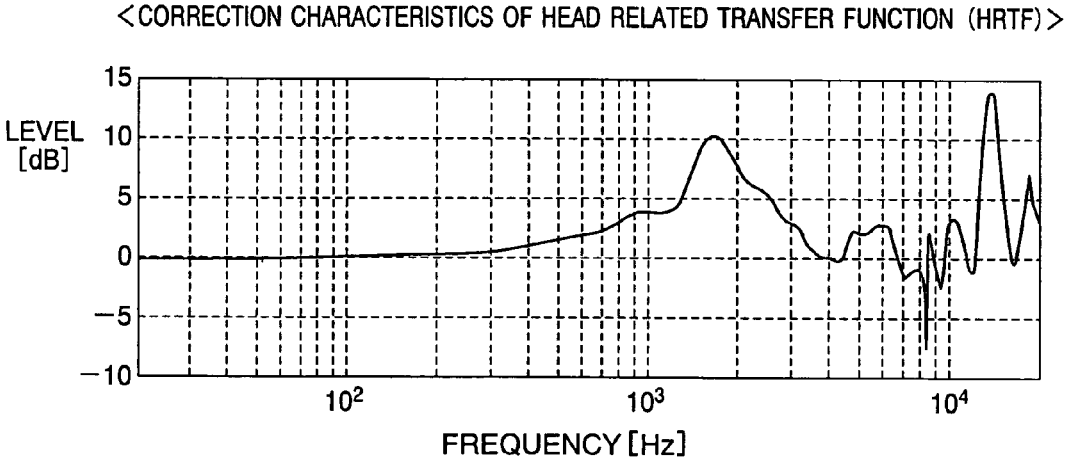
Figure 6:
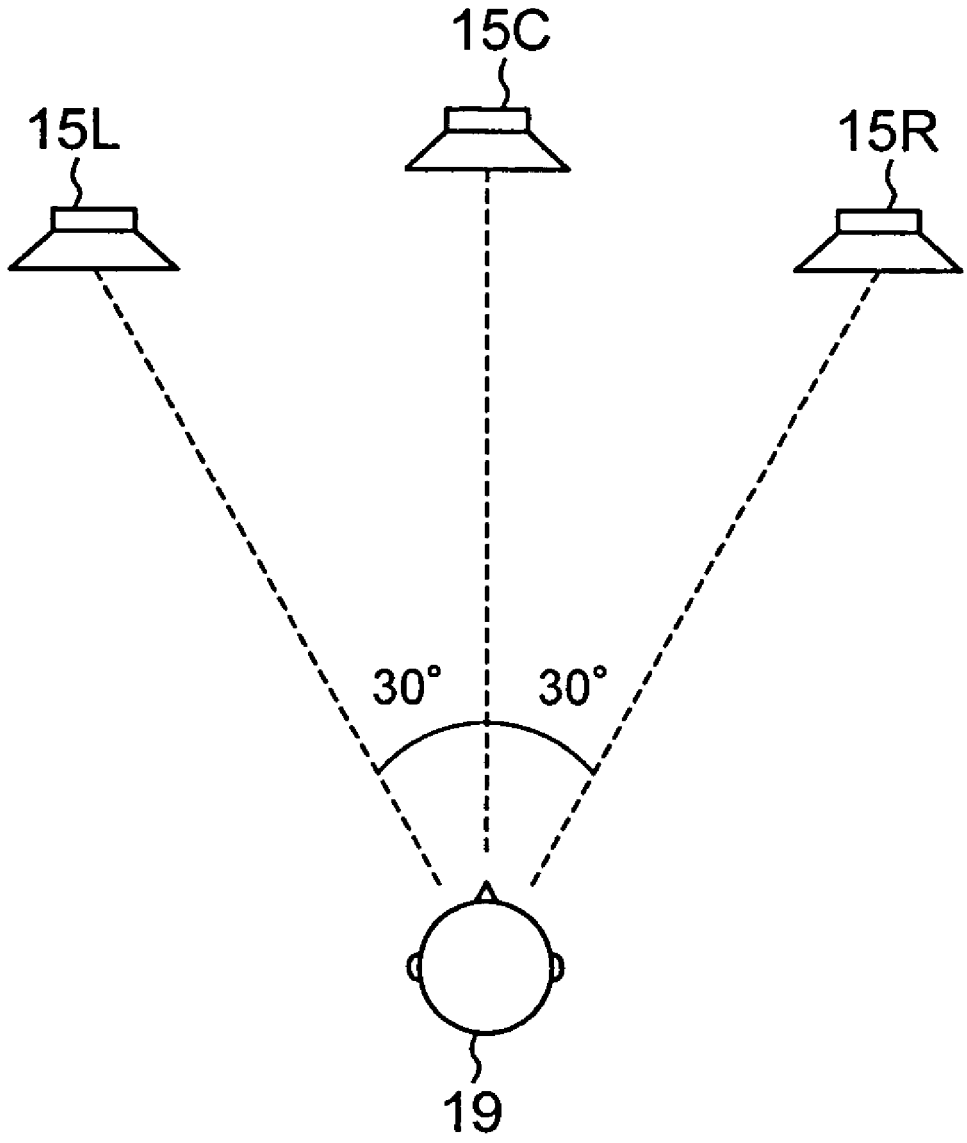
FIG. 6 is a view diagrammatically illustrating measuring conditions of the head related transfer function as shown in FIGS. 5A and 5B.

FIG. 5B shows the ratio of the frequency characteristics of the signal coming in the viewing direction of the audience to the frequency characteristics of the signal coming in the direction, which is deviated from the above-mentioned viewing direction by the angle of 30 degrees. More specifically, FIG. 5B shows the corrected characteristics by which the audience recognizes as if the sounds, which have been reproduced by means of the L-channel loudspeaker 15L and the R-channel loudspeaker 15R, can be heard from the central loudspeaker 15C. Accordingly, when the central channel audio signal is corrected in accordance with the corrected characteristics as shown in FIG. 5B, and the thus corrected central channel audio signal is then outputted from the L-channel loudspeaker 15L and the R-channel loudspeaker 15R, which are disposed on the lines, which are displaced from the above-mentioned viewing direction of the audience 19 rightward and leftward relative to the audience by the angle of 30 degrees, the audience recognizes in the auditory sense as if the sounds come in his/her viewing direction (i.e., the "0 degrees" position). The characteristics of the equalizer 101, as shown in FIG. 4, is determined based on the correction characteristics as shown in FIG. 5B so as to boost the band at around 1.7 kHz.

Figure 7A:
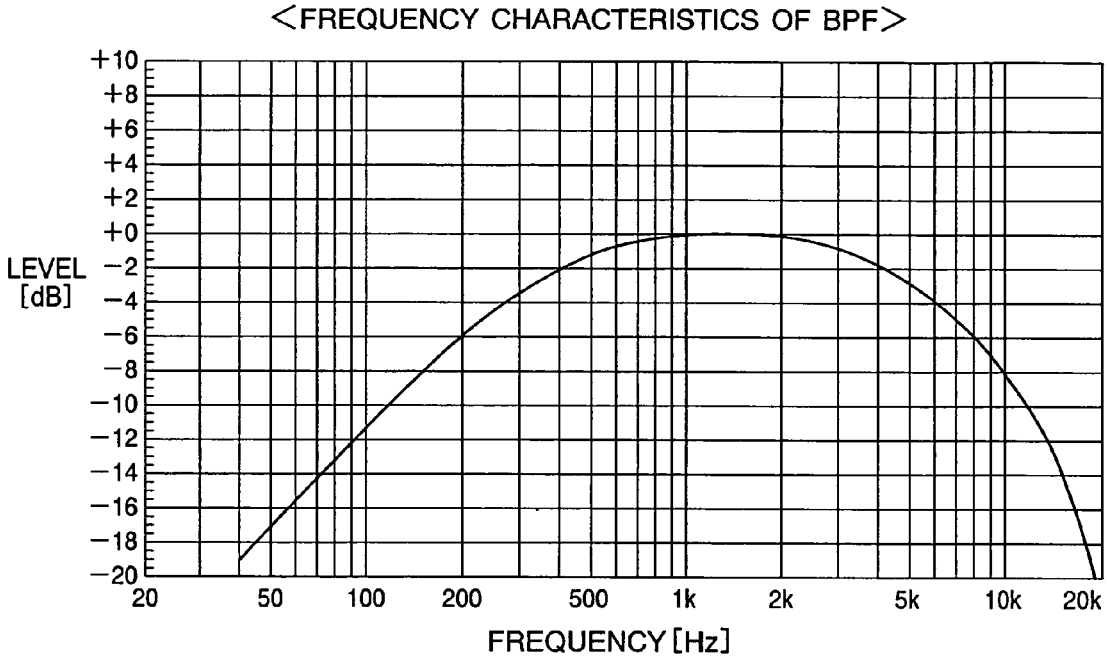
FIG. 7A is a graph showing frequency characteristics of a BPF (band pass filter) as shown in FIG. 3
Figure 7B:
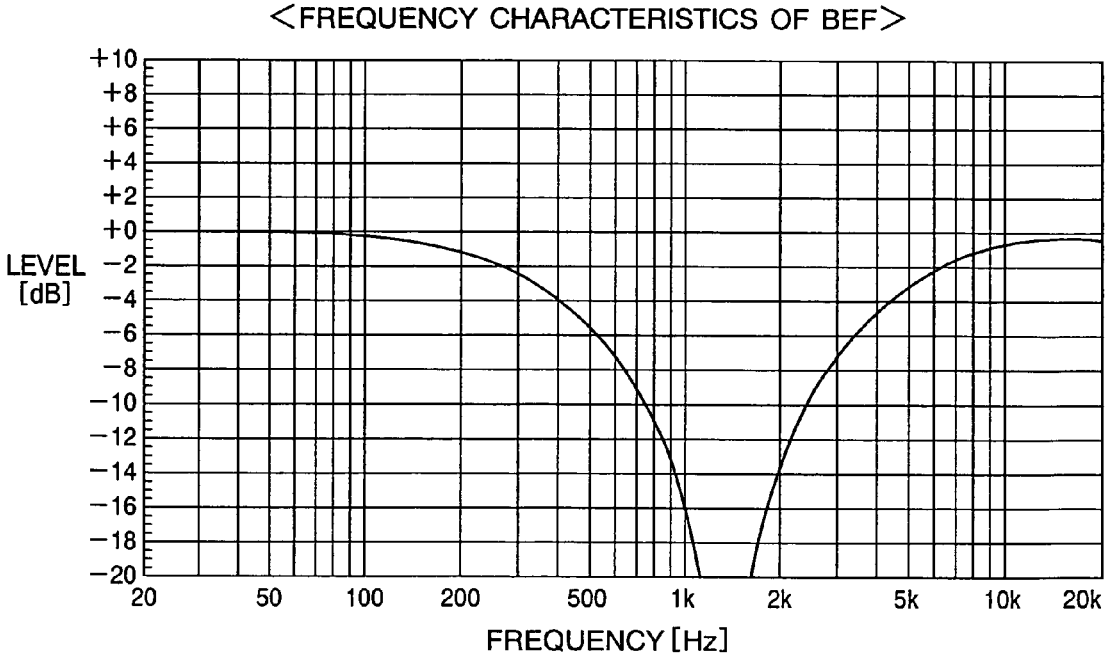
FIG. 7B is a graph showing frequency characteristics of a BEF (band eliminate filter) as shown in FIG. 3.

FIG. 7A shows the characteristics of the band-pass filer (BPF) 102 and FIG. 7B shows the characteristics of the band eliminate filter (BEF) 103. The BPF 102 is a filter for extracting the predetermined frequency band (midrange) mainly containing a human voice components from the input audio signal "Cin" for the central channel. On the contrary, the BEF 103 is a filter for removing the above-mentioned predetermined frequency band from the input audio signal "Cin". More specifically, the BEF 103 has the inverse characteristics relative to the BPF 102 and extracts lower and higher signal components, which cannot pass through the BPF 102. In an example, the BPF 102 allows the signal components having the band of around 1.3 kHz to pass through and the BEF 103 removes the signal components having the band of around 1.3 kHz.

The signal component, which has passed through the BPF 102, is subjected to a level adjustment processing in the amplifier 104, and then inputted into the two adders 105, 105 as shown in FIG. 3. The two adders 105, 105 include the L-channel audio signal "Lin" and the R-channel audio signal "Rin", which have been subjected to the level adjustment processing in the amplifiers 104, 104 and then inputted to the two adders 105, 105. Each adder 105 down-mixes the output signal (level-adjusted) from the BPF102 with the L-channel audio signal "Lin" or the R-channel audio signal "Rin" to generate the mixed signal. The adders 105, 105 output the mixed signals as the L-channel output audio signal "Lout" and the R-channel output audio signal "Rout" to the respective loudspeakers 15L and 15R. The output signal from the BEF 103 is subjected to the level adjustment processing in the amplifier 104, and then outputted as the C-channel output audio signal "Cout" to the central loudspeaker 15C.

Now, description will be given below in sequence of the processing of the signals of each channel based on the above-described configuration. The central channel signal "Cin" is inputted to the equalizer 101 so that the signal component having the band of around 1.7 kHz is boosted in accordance with the characteristics as shown in FIG. 4. Such an equalization processing imparts the characteristics to the central channel audio signal so that the sounds provided by the central channel audio signal outputted from the L-channel loudspeaker 15L and the R-channel loudspeaker 15R, which are disposed on the lines displaced from the above-mentioned viewing direction of the audience rightward and leftward relative to the audience by the angle of 30 degrees can be recognized to be come in the viewing direction of the audience.

Of the output signal from the equalizer 101, the components having the band corresponding to the human voice are extracted from the BPF 102 and subjected to the level adjustment processing in the amplifier 104, and then sent to the adders 105, 105. The adders 105, 105 include the L-channel audio signal "Lin" and the R-channel audio signal "Rin", which have been already inputted thereto. Accordingly, the adders 105, 105 output the signals in which the signal component having the band corresponding to the human voice of the central channel audio signal is added to the L-channel audio signal "Lin" and the R-channel audio signal "Rin", respectively. Reproduction of the above-mentioned signals outputted from the adders 105, 105 with the use of the loudspeakers 15R and 15L provided on the left and right-hand sides causes the signal component corresponding to the human voice of the central channel audio signal to be reproduced through the right and left-hand side loudspeakers 15R and 15L. As a result, the audience can recognize as if the sound comes in his/her viewing direction, i.e., from the center of the video monitor 18.

On the other hand, the BEF 103 extracts the signal components having the other band than that corresponding to the human voice, of the central channel audio signal, and then outputs them as the audio signal "Cout" to the C-channel loudspeaker 15C. As a result, the signal components other than the signal component corresponding to the human voice, of the central channel audio signal, are outputted from the central loudspeaker 15C.

In the present invention, the central channel audio signal, which contains the signal components corresponding to the human voice, is divided into the midrange in which the human voice components are mainly contained, and the other range, and the audio signal of the midrange is reproduced through the front loudspeakers, which are disposed on the right and left-hand side of the video monitor, thus making it possible to solve the problem that spoken words or vocalized lyrics can be heard from the central loudspeaker, which is disposed above or below the video monitor, so as to be inconsistent with an image displayed on the video monitor, thus causing an uncomfortable feeling.

Figure 8A:
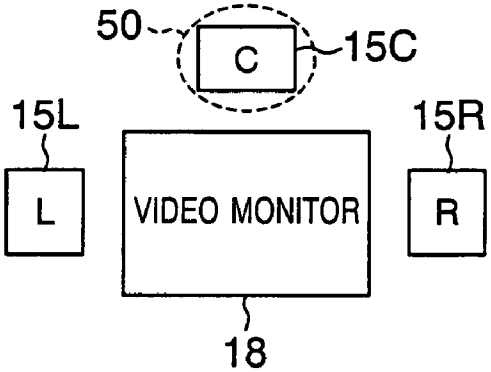
FIGS. 8A, 8B, 8C and 8D are views illustrating positions of audio images related to components of a human voice, which are obtained by the AV amplifier according to the example of the present invention.
Figure 8B:
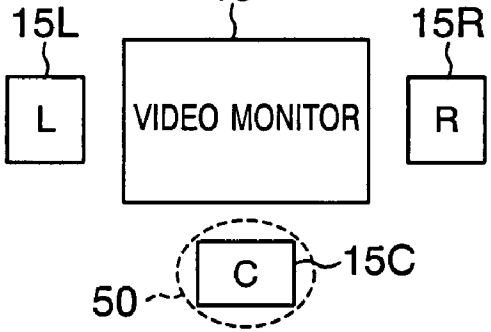
Figure 8C:
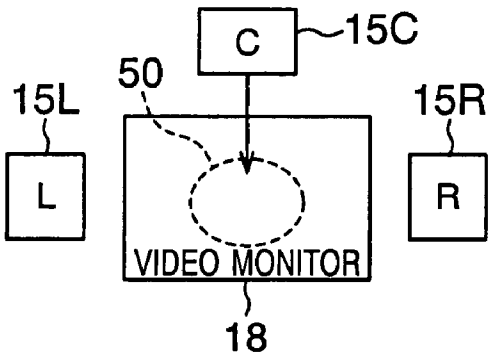
Figure 8D:
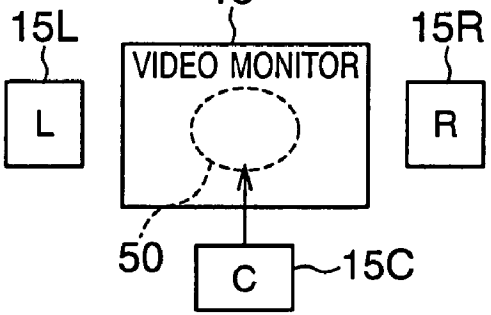

If the above-described processing according to the present invention is not carried out, an audience recognizes as of the sound based on the signal component corresponding to the human voice can be heard from the position of a circle 50 indicated in a broken line, i.e., from the central loudspeaker 15C, as shown in FIGS. 8A and 8B. Accordingly, the difference between the position of a person displayed on the video monitor 18 and the position from which the sound can be heard causes the audience to feel uncomfortable. On the contrary, according to the present invention, the audience always recognizes as if the sound based on the signal component corresponding to the human voice can be heard from the center of the video monitor, irrespective of the position of the central loudspeaker 15C, as shown in FIGS. 8C and 8D.

In addition, the processing of the central channel audio signal utilizing the equalizer in which the head related transfer functions are modeled, make it possible to localize the signals, which have the same phase and are reproduced by means of the L-channel loudspeaker and the R-channel loudspeaker, in the position of the video monitor, which is placed in front of the audience and in the middle between the L-channel loudspeaker and the R-channel loudspeaker, with the result that the clear reproduction of the audio signal can be carried out, without deteriorating the quality of the original sound.

Modifications

Now, description will be given below of some modifications of the front audio signal processing unit 100 with reference to FIGS. 9A, 9B and 9C.

Figure 9A:
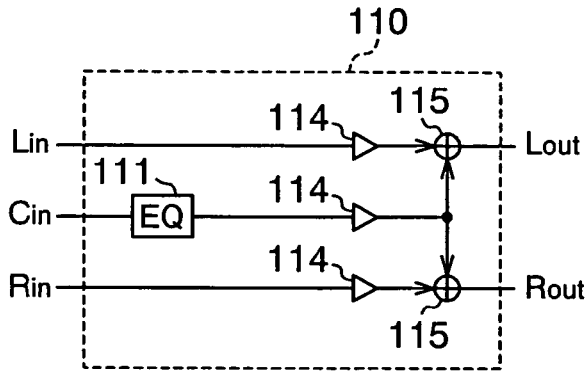
FIGS. 9A, 9B and 9C are views showing modifications of the front audio signal processing unit as shown in FIG. 1.

FIG. 9A shows a configuration of the front audio signal processing unit 110 in case where the present invention is applied to a system in which the audio signals of the L-channel, the C-channel and the R-channel are reproduced by means of two loudspeakers. In this modification, no existence of a C-channel loudspeaker leads to no processing utilizing a band-pass filter (BPF) and a band eliminate filter (BEF). The C-channel signal is boosted at the predetermined band by the equalizer 111, and down-mixed with the L-channel signal and the R-channel signal in the adders 115, 115, and then outputted. The equalizer 111 has the same characteristics as the equalizer 101 described above so that the signal having the band corresponding to the human voice is outputted from the right and left-hand side loudspeakers and the correction utilizing such an equalizer makes it possible for an audience to recognize as if the sound based on such a signal can be heard from the center of the video monitor, without causing any uncomfortable feeling.

Figure 9B:
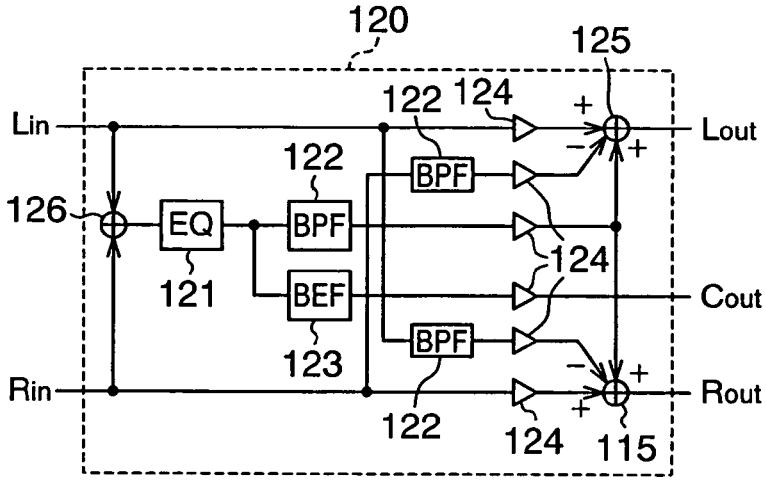

FIG. 9B shows a configuration of the front audio signal processing unit 120 in case where the present invention is applied to a system in which 2-channel stereo signals, which do not include any central channel audio signal, but includes only an L-channel and an R-channel, are reproduced by means of 3-channel loudspeakers including a central loudspeaker. In FIG. 9B, the L-channel audio signal "Lin" and the R-channel audio signal "Rin" are added together in an adder 126 and then inputted to an equalizer 121. In this modification, any C-channel audio signal does not exist, and the signal components having the band corresponding to the human voice are included in the L-channel audio signal "Lin" and the R-channel audio signal "Rin". The L-channel audio signal "Lin" and the R-channel audio signal "Rin" are added to generate signals including the signal components having the band corresponding to the human voice (i.e., the signals corresponding to the C-channel signal) and the thus generated signals are supplied to the equalizer 121. The equalizer 121 has the same characteristics as the equalizer 101 described above and the subsequent processing, which is carried out after the processing utilizing the equalizer 121, is the same as that as shown in FIG. 3. In addition, each channel audio signal is sent to the BPF 122 and the amplifier 124 and then subjected to a subtraction processing (i.e., a reverse addition processing) in the adder 125. In view of the fact that addition of signals, which have been obtained by processing the signals in which the L-channel audio signal "Lin" and the R-channel audio signal "Rin" are added together, with the respective L-channel and R-channel signals generates a path from the L-channel to the R-channel and the other path from the R-channel to the L-channel, the above-described processing is carried out to eliminate the other components than those boosted by means of the equalizer 121, in these paths. The above-described processing enables the audio signals to be reproduced without deteriorating a sound field of the original sound. The BPF 122 has the same characteristics as those of the BPF 102 described above.

Figure 9C:
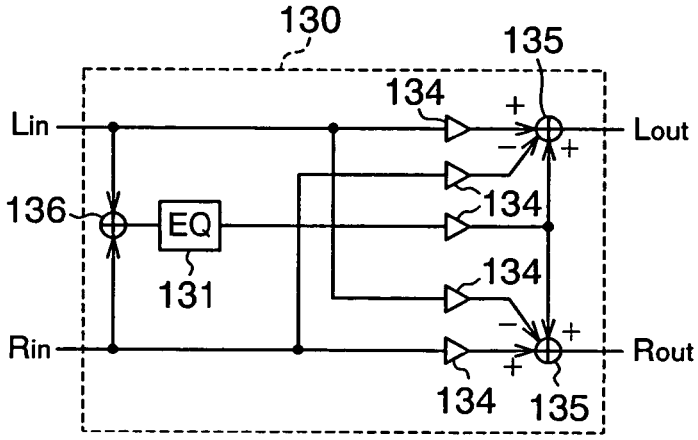

FIG. 9C shows a configuration of the further front audio signal processing unit 130 in case where the present invention is applied to a system in which 2-channel stereo signals, which do not include any central channel audio signal, but includes only an L-channel and an R-channel, are reproduced by means of 2-channel loudspeakers having no central loudspeaker. The input signal includes no central channel signal, and the L-channel audio signal "Lin" and the R-channel audio signal "Rin" are added together in an adder 136 to generate signals including components having the band corresponding to the human voice and then the thus generated signals are inputted to an equalizer 131 in the same manner as shown in FIG. 9B. The equalizer 131 has the same characteristics as the equalizer 101 described above. The output signal from the equalizer 131 is down-mixed with the L-channel audio signal "Lin" and the R-channel audio signal "Rin" at the adders 135, 135. Each channel audio signal is sent to the amplifier 134 and then subjected to a subtraction processing (i.e., a reverse addition processing) in the adder 135, and then outputted.

The configurations as shown in FIGS. 9B and 9C make it possible to equalize manly the components having the same phase of the L-channel audio signal and the R-channel audio signal in an effective manner. This is effective in view of the fact that there are many cases where, in the 2-channel stereo audio signal, the audio signal components corresponding to the human voice, such as vocalized lyrics of a musical source or spoken words of a movie are contained in the L-channel and the R-channel in the same phase.

Figure 10:
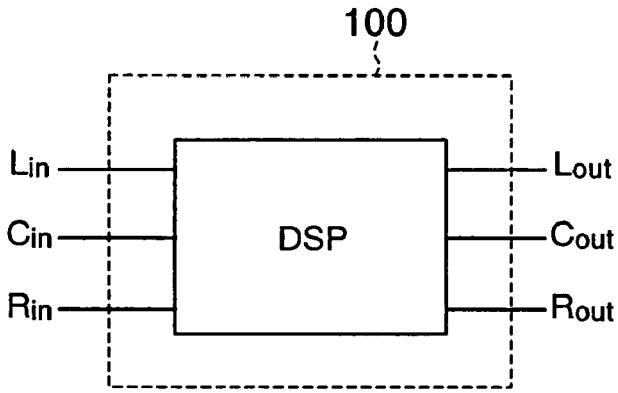
FIG. 10 is view showing another example of the front audio signal processing unit as shown in FIG. 1.
Figure 11:
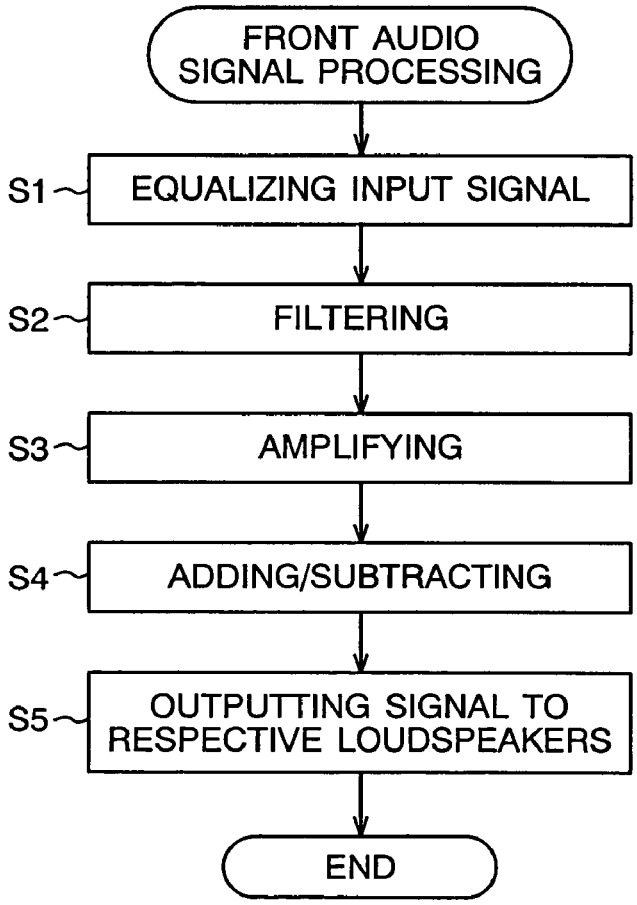
FIG. 11 is a flowchart of processing executed by the front audio signal processing unit as shown in FIG. 10.

In the above-described examples, the front audio signal processing unit is configured by utilizing the hardware circuit. It is however possible to carry out the same processing through a software processing utilizing a digital signal processor (DSP). An example of the front audio processing unit 100 in such a case is shown in FIG. 10. The front audio processing unit 100 executed by the DSP is shown in FIG. 11. The processing as shown in FIG. 11, which is basically the same as the signal processing executed by the hardware as shown in FIG. 3, is executed by the DSP based on the predetermined processing program. More specifically, the DSP equalizes the audio signal of the central channel in accordance with the correction characteristics described above (Step S1), carries out the filtering processing in accordance with the same characteristics as the BPF and BEF (Step S2), and then the amplifying processing to make a level adjustment (Step S3). Then, the signal, which has been subjected to the filtering processing, is added to an R-channel audio signal and an L-channel audio signal to generate an R-channel output audio signal Rout and an L-channel output audio signal Rout (Step S4). Then, the thus generated R-channel and L-channel output audio signals Rout and Lout, and a C-channel output audio signal Cout, which has been obtained through the filtering processing, are outputted to the corresponding loudspeakers (Step S5).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2003-55408 filed on Mar. 3, 2003 including the specification, claims, drawings and summary is incorporated herein by reference in its entirety.

What is claimed is:

1. A circuit for processing audio signals in a plurality of channels comprising a right channel, a left channel and a central channel, the circuit comprising:

a frequency characteristics correction device for correcting frequency characteristics of an audio signal of the central channel, utilizing correction characteristics determined based on a head related transfer function to output a corrected signal; and a band-pass filter for extracting a predetermined frequency band from the corrected signal from the frequency characteristics correction device to output an extracted signals;

a band eliminate filter for removing said predetermined frequency band from the corrected signal from the frequency characteristics correction device to output central channel audio signals;

an output device for mixing said extracted signal with an audio signal of the right channel and an audio signal of the left channel to generate mixed output audio signals, and outputting said mixed output audio signals as a right channel output audio signal and a left channel output audio signal.

2. The circuit as claimed in claim 1, further comprising:

a device for mixing the audio signal of said right channel with the audio signal of said left channel to generate a mixed input audio signal, said frequency characteristics correction device correcting frequency characteristics of said mixed input audio signal.

3. The circuit as claimed in claim 1, wherein:

said correction characteristics are determined based on a ratio of the head related transfer function for a sound, which is propagated in a straight direction to a front side of an audience, to the head related transfer function for a sound, which is propagated to the audience in a direction deviating rightward or leftward from said straight direction by a predetermined angle.

4. The circuit as claimed in claim 1, wherein:

said predetermined frequency band comprises frequency bands corresponding to a human voice.

5. An apparatus for reproducing audio signals, comprising:

a decoder for decoding input audio stream data to generate audio signals of a plurality of channels; and a circuit for processing audio signals in a plurality of channels comprising a right channel, a left channel and a central channel, said circuit comprising (i) a frequency characteristics correction device for correcting frequency characteristics of an audio signal of the central channel, utilizing correction characteristics determined based on a head related transfer function to output a corrected signal; (ii) a band-pass filter for extracting a predetermined frequency band from the corrected signal from the frequency characteristics correction device to output an extracted signal; (iii) a band eliminate filter for removing said predetermined frequency band from the corrected signal from the frequency characteristics correction device to output central channel audio signals; and (iv) an output device for mixing said extracted signal with an audio signal of the right channel and an audio signal of the left channel to generate mixed output audio signals, and outputting said mixed output audio signals as a right channel output audio signal and a left channel output audio signal.

6. A program for reproducing audio signals in a plurality of channels comprising a right channel, a left channel and a central channel, which is to be executed by a computer, to cause the computer to function as:

a frequency characteristics correction device for correcting frequency characteristics of an audio signal of the central channel, utilizing correction characteristics determined based on a head related transfer function to output a corrected signal; and a band-pass filter for extracting a predetermined frequency band from the corrected signal from the frequency characteristics correction device to output an extracted signal;

a band eliminate filter for removing said predetermined frequency band from the corrected signal from the frequency characteristics correction device to output central channel audio signals;

an output device for mixing said extracted signal with an audio signal of the right channel and an audio signal of the left channel to generate mixed output audio signals, and outputting said mixed output audio signals as a right channel output audio signal and a left channel output audio signal.

* * * * *